United States Patent [19]

Kawaguchi et al.

[11] Patent Number: 4,509,568

[45] Date of Patent: Apr. 9, 1985

[54] GRANULAR MATERIAL PROCESSING APPARATUS WITH SEAL FOR STIRRER SHAFT OR THE LIKE FORMED BY THE GRANULAR MATERIAL

[75] Inventors: Toshihiro Kawaguchi, Osaka; Mineo Ishizaka, Hikari; Hiyoshi Doi, Izumisano, all of Japan

[73] Assignee: Takeda Chemical Industries, Ltd., Osaka, Japan

[21] Appl. No.: 502,232

[22] Filed: Jun. 8, 1983

[30] Foreign Application Priority Data

Dec. 10, 1982 [JP] Japan ..... 57/217380

[51] Int. Cl.[3] ..... B65B 43/42

[52] U.S. Cl. ..... 141/129; 141/46; 141/144; 141/392

[58] Field of Search ..... 141/8, 46,67, 69, 144–152, 141/129, 135, 250, 266, 280, 392; 308/187.1; 384/130–132; 277/1, 3

[56] References Cited

U.S. PATENT DOCUMENTS

| | | | |
|---|---|---|---|
| 2,799,982 | 7/1957 | Dodge | 141/144 |
| 3,154,117 | 10/1964 | Florin | 141/144 |
| 3,578,778 | 5/1971 | Matthews et al. | 141/144 |
| 3,804,423 | 4/1974 | Booy | 277/1 |
| 4,365,815 | 12/1982 | Scott | 277/3 X |

*Primary Examiner*—Stephen Marcus
*Assistant Examiner*—Ernest G. Cusick
*Attorney, Agent, or Firm*—Wenderoth, Lind & Ponack

[57] ABSTRACT

A granular material processing apparatus provided with an improved sealing arrangement for the granular material, which is so arranged that, instead of employing an ordinary packing member conventionally used for a known sealing arrangement, a packing portion is formed by the granular material itself present in the processing apparatus for tightly closing the gaps or clearances between stationary container members and movable processing members, thereby to completely eliminate troubles, spilling of the granular material and mixing of foreign matters into the granular material arising from abrasion or deterioration of a packing member, if such packing member should be employed.

5 Claims, 10 Drawing Figures

GRANULAR MATERIAL PROCESSING APPARATUS WITH SEAL FOR STIRRER SHAFT OR THE LIKE FORMED BY THE GRANULAR MATERIAL

BACKGROUND OF THE INVENTION

The present invention generally relates to an apparatus for processing materials in powder or granular form (referred to as a granular material processing apparatus hereinbelow), and more particularly, to a sealing arrangement which is adapted to tightly close or seal gaps or clearances between a stationary container means, for example, a hopper for accommodating therein the granular material to be processed and a movable processing means, for example, a stirrer rotatably mounted within said hopper, in the filling or processing apparatus, for example, for pharmaceutical granular and powdery materials so as to prevent undesirable entry or mixing of foreign matters into the granular and powdery material being processed, through such gaps.

Conventionally, in a granular material filling or processing apparatus as referred to above, it has been generally so arranged that, for example, in the hopper for storing therein the granular and powdery material (referred merely to as granular material hereinbelow) and the stirrer for agitating the granular material accommodated in said hopper, a stirring or rotary shaft for supporting stirring blades of the stirrer extends through a side wall of the hopper, with the side wall being tightly closed or sealed by an ordinary packing member at such portion so as to prevent undesirable spilling or scattering of the granular material by the packing member thus provided.

However, in known arrangement as described above, there have been such disadvantages that, since metallic material, resinous material, felt, or the like are normally employed for the packing member, it has been difficult to fully eliminate troubles due to wearing of the packing member, or spilling of granular materials owing to deterioration of the packing member, etc., particularly with a possibility that particles or chips of the packing member are undesirably mixed into the granular material being processed due to abrasion or deterioration of such packing member. Thus the prior art arrangement has not been very satisfactory especially when the granular material to be processed is intended for pharmaceutical use.

SUMMARY OF THE INVENTION

Accordingly, an essential object of the present invention is to provide a granular material processing apparatus provided with an improved sealing arrangement for the granular material, which, instead of employing an ordinary packing member conventionally used for a known sealing arrangement, employs a packing portion formed by the granular material itself present in the processing apparatus for tightly closing the gaps or clearances between a stationary container means and a movable processing means, thereby to completely eliminate troubles, spilling of the granular material and mixing of foreign matters into the granular material arising from abrasion or deterioration of a packing member, if such packing member should be employed.

Another important object of the present invention is to provide a granular material processing apparatus of the above described type which has a simple construction and functions stably, and can be readily manufactured at low cost.

In accomplishing these and other objects, according to one preferred embodiment of the present invention, there is provided a granular material processing apparatus which includes a stationary container means for storing and transferring granular material, a rotary or movable processing means coupled with a driving means for stirring and dispensing the granular material, with the stationary container means and the movable processing means being provided adjacent to each other so as to constitute part of the processing apparatus, and a sealing arrangement for preventing leakage of the granular material in the stationary container means, out of said stationary container means through a gap or clearance between the stationary container means and the movable processing means. The sealing arrangement further includes a porous plate means which is provided with a large number of pores having diameters smaller than the particle diameters of the granular material and extending through the porous plate means from a front face to a reverse face thereof, and which is provided on the surface of a portion of said stationary container means confronting said movable processing means, a pressure reduction introducing portion provided between the stationary container means and the porous plate means for coupling the reverse face of said porous plate means with a pressure reducing means, and a granular material collecting portion provided in a portion at the outer side continuous to said porous plate means of the stationary container means defining said gap and coupled with a forcible removing means for the granular material open at an outer side of said gap, thereby to tightly close the gap between said stationary container means and the movable processing means by the granular material attracted onto the front face of said porous plate means, and also to forcibly remove from said granular material collecting portion, the granular material leaking outside through said gap.

More specifically, the fundamental feature of the present invention is that, since the movable processing means, for example, a stirrer is moved with respect to the stationary container means, for example, a hopper, when the porous plate means, i.e. a porous member is provided at the gap or clearance defining portion of the stationary container member, with the gap being further subjected to pressure reduction from the reverse face of the porous member so that the granular material is attracted onto the front face of the porous member, the granular material thus attracted onto the porous member is momentarily accumulated on the surface of said porous member so as to normally fill the gap by the granular material, with the result that such gap is tightly closed or sealed by the granular material thus accumulated. By the above arrangement, it becomes unnecessary to employ the ordinary packing member as in the conventional arrangement, while the optimum sealing effect may be maintained at all times, and thus, the sealing is effected by the granular material itself, without any possibility of troubles or leakage of granular material due to abrasion or deterioration of the packing member, and undesirable mixing of foreign matters such as particles or chips of the packing member into the granular material to be processed is avoided.

Moreover, when a means for forcibly removing the granular material towards the outside continuously, for example, by a suction force is provided at the outside of the granular material accumulating portion at the gap, the granular material not sufficiently attracted and spilling from the accumulation of the granular material filling in the gap is immediately attracted so as to be discharged outside of the gap without scattering, and thus, not only is the arrangement preferable from the sanitary point of view, but there is no possibility that neighboring other devices, etc. are adversely affected by such scattering granular material.

Furthermore, in the granular material processing apparatus according to the present invention, there is provided a filter at the bottom of each of a plurality of granular material filling holes opening out of the outer peripheral surface of a rotary wheel arranged to be intermittently rotated between a granular material filling position and a granular material dispensing position so as to fill the granular material into the corresponding filling hole by sucking action from said filter, and also to discharge the granular material accommodated in the filling hole out of the opening by air fed from the filter. More specifically, in the filling hole having a cylindrical shape, a cylinder for receiving the granular material is further accommodated so as to allow positional adjustment thereof, with the filter being provided at the bottom of said cylinder in a flat state, while the inner face of said cylinder is in a conical tapered configuration enlarged towards the opening of the filling hole. By the above arrangement, accuracy in filling the granular material is markedly improved, while clogging of the filter by the granular material, granular material remaining within the filling holes after discharging, etc. can be advantageously prevented.

BRIEF DESCRIPTION OF THE DRAWINGS

These and other objects and features of the present invention will become apparent from the following description of a preferred embodiment thereof given with reference to the accompanying drawings, in which.

DETAILED DESCRIPTION OF THE INVENTION

Figure 1:
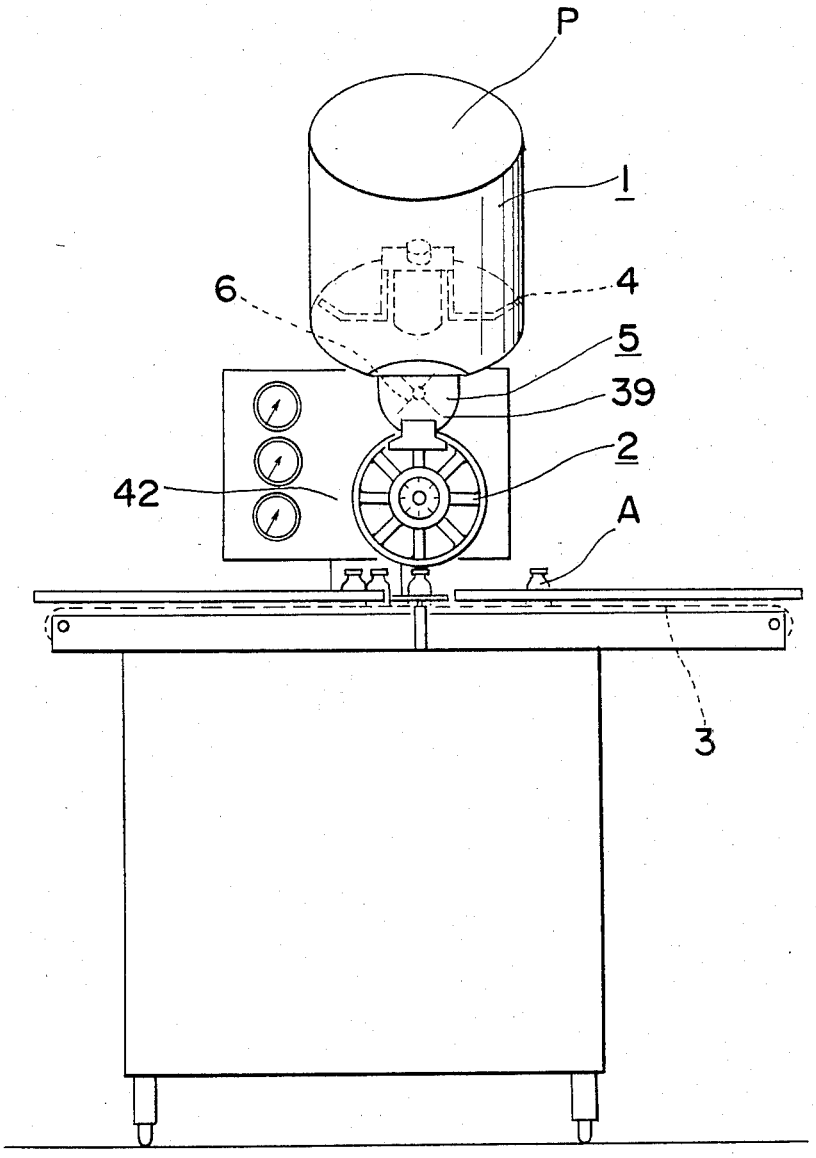
FIG. 1 is a schematic front elevational view showing a general construction of a granular material processing apparatus provided with an improved sealing arrangement according to one preferred embodiment of the present invention.

Before the description of the present invention proceeds, it is to be noted that like parts are designated by like reference numerals throughout the accompanying drawings.

Figure 2:
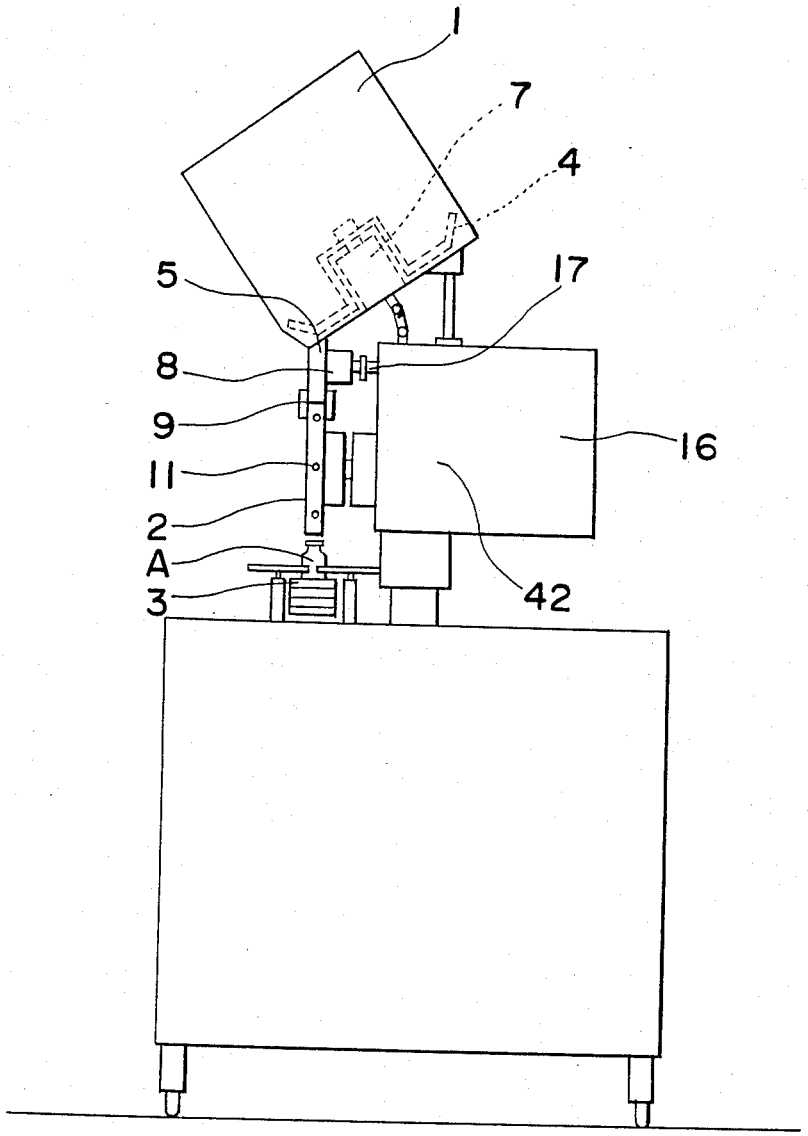
FIG. 2 is a side elevational view of the granular material processing apparatus of FIG. 1.
Figure 3:
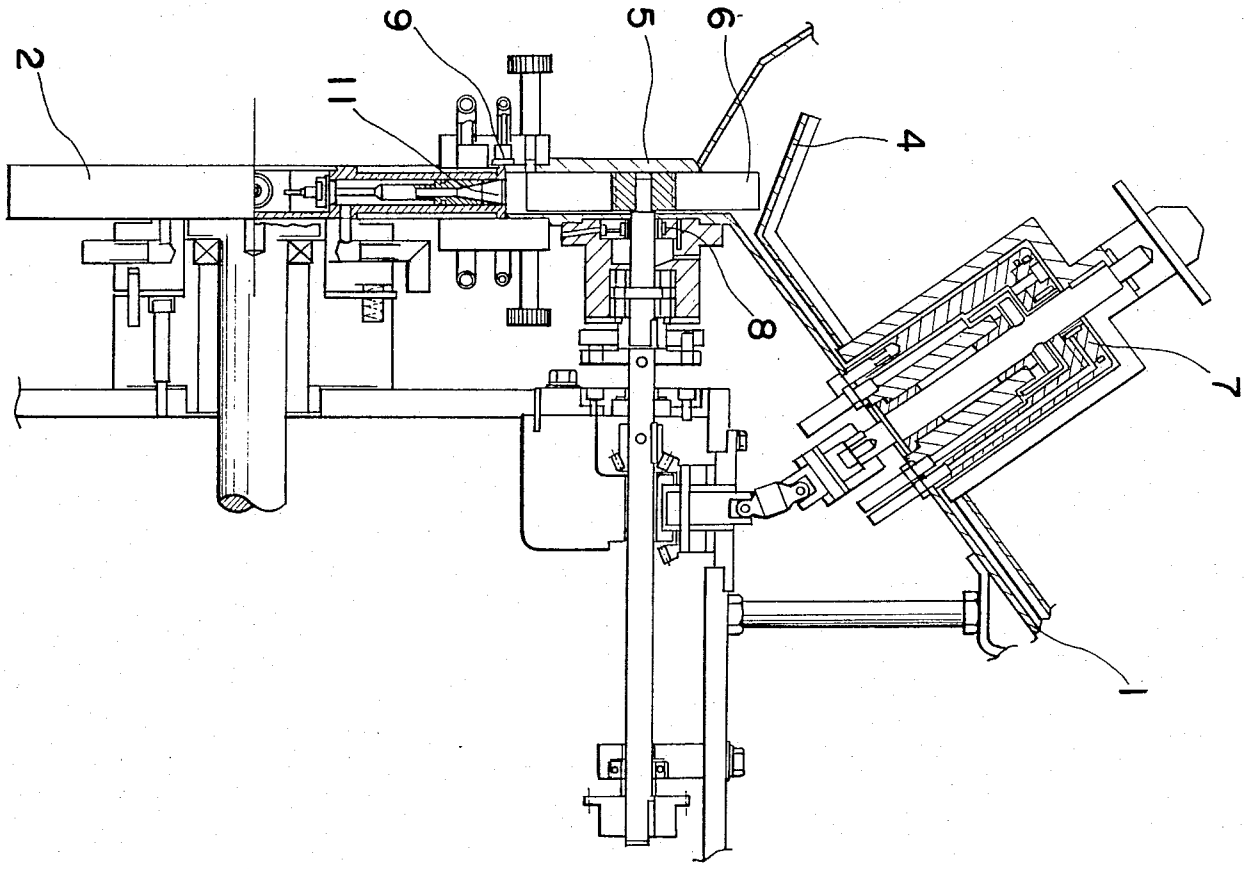
FIG. 3 is a side sectional view showing, on an enlarged scale, the construction of the sealing arrangement employed in the granular material processing apparatus in FIG. 1, FIGS. 4 to 6 are respectively cross sectional views showing, on enlarged scales, essential portions of the sealing arrangement employed in the processing apparatus shown in FIG. 2.

Referring now to the drawings, there is shown in FIGS. 1 and 2 a granular material processing or filling apparatus according to one preferred embodiment of the present invention, which generally includes a hopper 1 for storing granular material P therein, a duct 5 provided below and communicated with said hopper 1 to extend downwardly from said hopper 1 for receiving the granular material P fed from said hopper 1, a rotary wheel 2 for filling the granular material, rotatably provided below a granular material feed opening 39 (FIG. 8) formed at a lower portion of said duct 5, and a conveyor 3 for transporting vials or bottles A, movably provided below and adjacent to said rotary wheel 2 so as to fill a predetermined amount of the granular material P contained in the hopper 1 into the vials A by the rotary wheel 2. Within the hopper 1, a stirrer 4 is rotatably provided for agitating the granular material P, while a rotary blade 6 is rotatably disposed in the duct 5 for feeding the granular material P, and a sealing arrangement according to the present invention including sealing units 7, 8 and 9 each having a porous member to be described later are respectively provided at a shaft portion of the stirrer 4, a shaft portion of the rotary blade 6, and also, at a connecting portion between the duct 5 and the rotary wheel 2 as shown in FIG. 3.

More specifically, at a central bottom portion of the hopper 1 for storing the granular material P, the stirrer 4 is rotatably provided, and the rotary blade 6 is also rotatably mounted in the duct 5 provided at the lower portion of the hopper 1, while the rotary wheel 2 is provided below and adjacent to the duct 5 for intermittent rotation, so that, upon rotation of the stirrer 4, the granular material P stored in the hopper 1 is agitated so as to be induced into the duct 5, and subsequently directed downwardly by the rotation of the rotary blade 6 so as to be filled into the corresponding filling hole 11 confronting the duct 5 among the plurality of filling holes 11 provided in the outer peripheral surface of the rotary wheel 2 at a predetermined interval or pitch. Thereafter, the rotary wheel 2 effects a half rotation about its axis to bring the filling hole 11 filled with the granular material P as described above, into confrontation with a vial A transported by the conveyor 3 so as to supply the granular material P in said filling hole 11 into the vial A.

Figure 4:
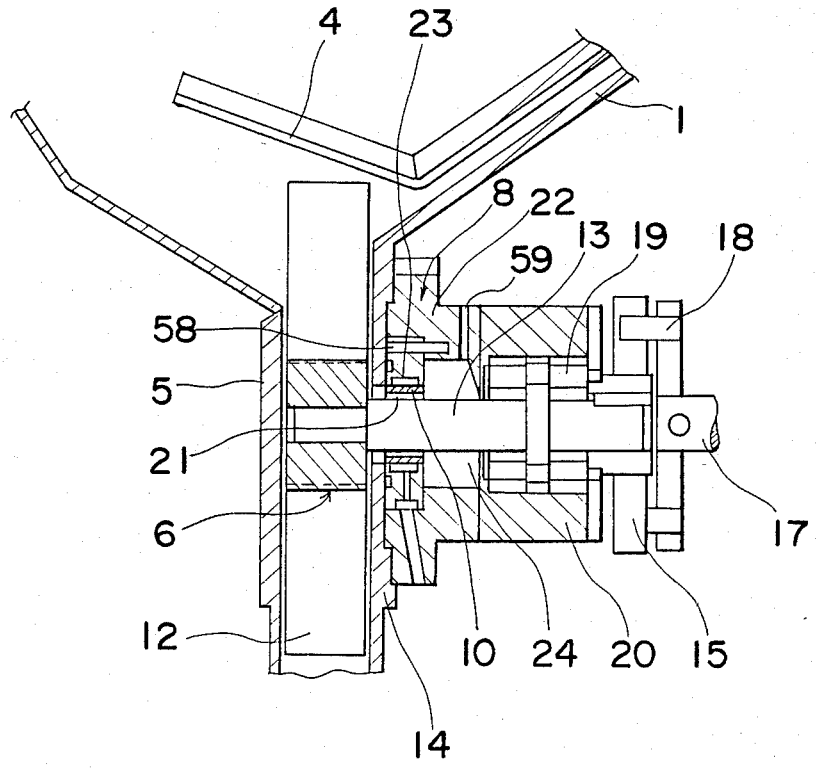

As shown in FIG. 4, the rotary blade 6 includes a rotary shaft 13 having blade members 12 fixedly mounted thereon, and rotatably accommodated in the duct 5 for rotation in a vertical plane of said duct 5. The rotary shaft 13 extending through one side wall 14 of said duct 5 is rotatably journalled in a bearing mechanism equipped with the sealing unit 8 including a porous member 10 and mounted on the outer side of said side wall 14. On the other hand, at the forward end of the rotary shaft 13, there is provided a T-shaped portion 15, which is coupled with a corresponding U-shaped portion 18 provided on an output shaft 17 of a driving unit 16 including a motor and a reduction gear, etc. (not specifically shown), so that the rotary blade 6 is rotated in one direction (i.e. counterclockwise in FIG. 1) by the driving unit 16.

More specifically, as shown in FIG. 4, in the bearing mechanism equipped with the sealing unit 8 as described above, a ring-shaped retaining housing 20 for supporting a ball bearing 19 in which the rotary shaft 13 of the rotary blade 6 is directly journalled, and a ring-shaped sealing housing 22 provided at the front side of said retaining housing 20 for rotatably receiving the rotary shaft 13 and having a gap or clearance 21 of a predetermined size in which the porous member 10 is provided, are combined with each other by a bolt 58 so as to be mounted on the one side wall 14 of the duct 5, for example, by fixing bolts (not shown). In the inner peripheral face of the sealing housing 22 confronting the gap 21, a pressure reducing chamber 23 in the form of an annular concave groove is provided, while the porous member 10 of predetermined dimensions which is provided with a large number of small openings or pores each having diameters smaller than the diameters of the granular material particles, and extending therethrough from the front face to the reverse face thereof so as to form a kind of filter, is applied onto the front face of the concave groove for the pressure reducing chamber 23. Moreover, on the outer side of said pressure reducing chamber 23, there is provided a collecting chamber 24 for the granular material formed by an annular stepped groove communicated with the gap 21, with said pressure reducing chamber 23 and collecting chamber 24 being further coupled with a suction device (not shown), for example, a vacuum pump or the like, respectively through suction hoses (not shown).

Accordingly, when the pressure reducing chamber 23 of the sealing housing 22 is subjected to pressure reduction through the suction hose, the granular material present in the granular material supply duct 5 is attracted onto the surface of the porous member 10 by the pressure reduction produced in the gap between the rotary shaft 13 of the rotary blade 6 and the sealing housing 22 so as to be successively accumulated on the porous member 10 for filling up the gap 21, with the result that said gap 21 is tightly closed or sealed by the accumulation of the granular material itself which has been compacted or solidified, as it were, through deaeration by the pressure reduction and consequent attraction between particles of said granular material. Accordingly, the gap 21 between the rotary shaft 13 and the sealing housing 22 is closed at all times even during rotation of the rotary blade 6.

Moreover, when the collecting chamber 24 of the sealing housing 22 is simultaneously subjected to the pressure reduction through the suction hose, even if part of the granular material accumulated in the gap 21 leaks into the collecting chamber 24 on the outside, such leaking granular material is immediately drawn out of the collecting chamber 24 through the suction hose for forced removal towards an external dust collecting chamber or the like (not particularly shown).

As described above, since the collecting chamber 24 is arranged only to draw the granular material leaking out of the gap 21 towards the outside, the degree of pressure reduction in the collecting chamber 24 may be smaller than that in the pressure reducing chamber 23 for the porous member 10, and in the arrangement of FIG. 4, the degree of pressure reduction is lowered through suction of external air via a through-hole 59 formed in the sealing housing 22 for communication with atmosphere. In addition to the above, if an ordinary packing piece for sealing the rotary shaft 13 is provided at the front side of the ball bearing 19, leakage of the granular material towards the outside and particularly an adverse effect on the ball bearing 19 thereby, may be perfectly prevented.

On the other hand, for the porous member 10 provided at the front face side of the pressure reducing chamber 23, there may be employed any porous materials of proper dimensions and strength, provided with a large number of pores extended therethrough from the front face to the reverse face thereof and having diameters smaller than the diameters of the granular material particles so as to allow air to pass, but to prevent the granular material from passing therethrough. For the porous materials as described above, there may be raised used, for example, ceramics, sintered metals (e.g. bronze, stainless steel, etc.), porous plastics (e.g. acrylonitrile styrene copolymer, etc.), various kinds of cloth or wire meshes and so forth. It is desirable that the area occupied by the porous member 10, dimensions of the gap, degree of pressure reduction for the pressure reducing chamber, etc. be properly selected according to various factors such as the kinds of the granular material and mixing ratio thereof with respect to air and the like, and, for example, in the case where the granular material has particle diameters in the range of 3 to 500 microns (200 microns on the average), it is preferable to employ, as the porous member, a sintered metal mesh of stainless steel with 2 microns mesh size, which is prepared by sintering superposed wire meshes of about 1.7 mm in thickness. The degree of pressure reduction may be in the range of 50 Torr to 700 Torr in the above case. In a filling apparatus intended for pharmaceutical granular material, since the granular material generally has small particle diameters, the porous member of sintered metal having pores of 2 microns in diameter, and measuring 5 to 15 mm in length and 1.7 mm in thickness, is provided on the surface of the pressure reducing chamber 23, with the gap 21 with respect to the rotary shaft 13 of the rotary blade 6 being in the range of 0.5 to 2 mm. It is preferable in this case that the gap 21 be reduced as much as possible, while the length of the porous member 10 be increased as much as practicable.

The sealing units 7 and 9 having the construction similar to that of the sealing unit 8 at the shaft portion of the rotary blade 6 as described so far, may be respectively provided at the shaft portion of the stirrer 4, and also, at the coupling portion between the duct 5 and the rotary wheel 2 in a manner as described hereinbelow.

Figure 5:
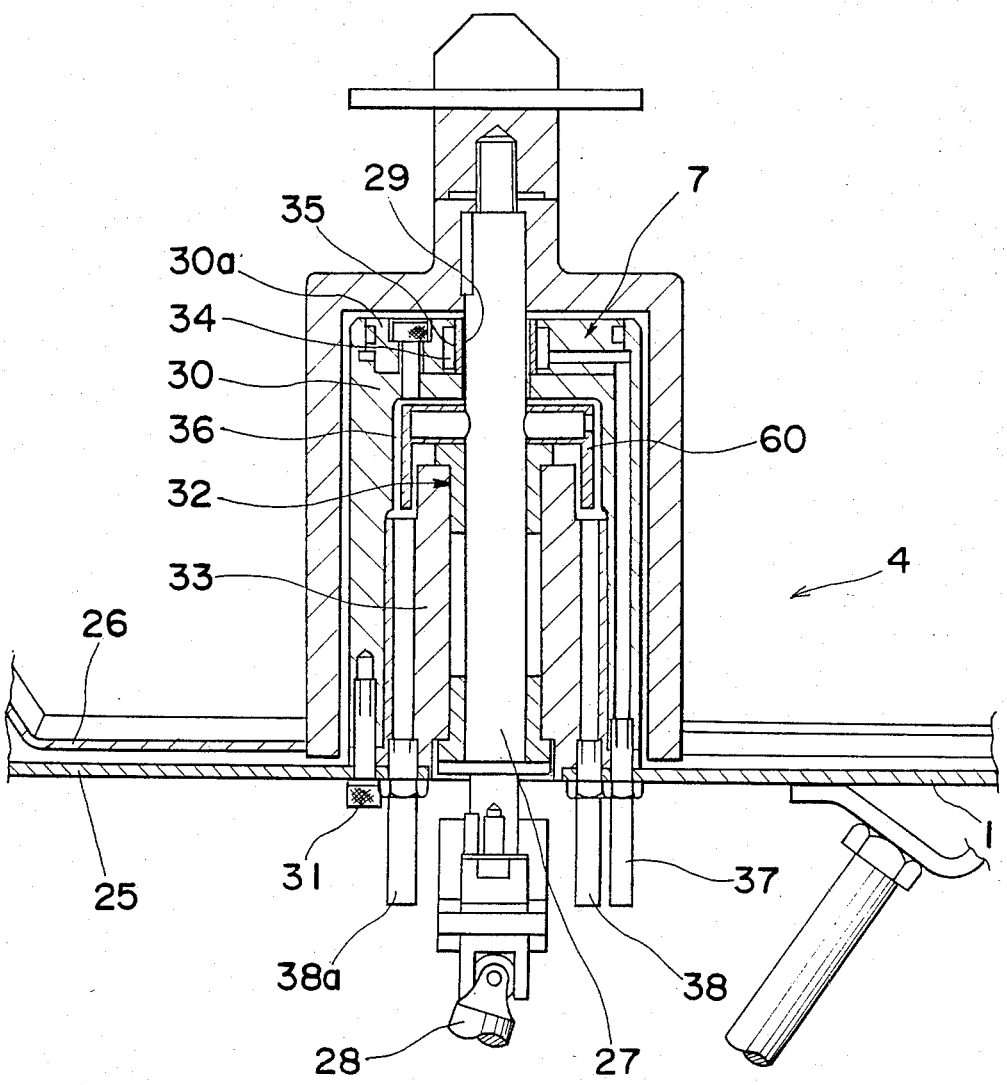

As shown in FIG. 5, the stirrer 4 equipped with the sealing unit 7 includes stirring blades 26 disposed on a bottom wall 25 of the hopper 1 inclined towards the duct 5, and a rotary shaft 27 provided at the center of said stirring blades 26. The stirring blades 26 are rotatably provided above and adjacent to the bottom wall 25 of the hopper 1 within said hopper, and the rotary shaft 27 extends through the inclined bottom wall 25 of the hopper 1, with the leakage of the granular material being prevented by the sealing unit 7 provided inside the inclined wall 25, whil the rotary shaft 27 is rotatably supported by a bearing mechanism to be described later. Furthermore, the distal end portion of the rotary shaft 27 extending downwardly out of the inclined bottom wall 25 is coupled with a gear system of the driving unit for the motor, etc. through a universal joint 28 so as to drive the stirring blades 26 in one rotational direction (i.e. clockwise in FIG. 1) by said driving unit.

Still referring to FIG. 5, in the sealing unit 7 as described above, a sealing housing 30 having incorporated therein a sealing ring **30*a* in which the rotary shaft 27 of the stirrer 4 is rotatably fitted, and which is provided with a porous member 35 spaced by a gap 29 from the surface of said rotary shaft 27, is mounted on the inclined wall 25 by a bolt 31, while a retaining housing 33 having incorporated therein a bearing 32 for rotatably supporting the rotary shaft 27, is provided inside the above sealing housing 30, with said retaining housing 33 being clamped together with the sealing housing 30 for fixing on the inclined wall 25 by the bolt 31. In the inner peripheral wall of the sealing ring 30***a* is a pressure reducing chamber 34 in the form of an annular concave groove, and the porous member 35 having a structure similar to the porous member 10 in the sealing unit 8 for the rotary blade 6 as described earlier, is applied onto the front face of said inner peripheral wall over said annular concave groove, and a collecting chamber 36 communicated with the gap 29 is provided between the sealing housing 30 and the retaining housing 33 for collecting the granular material falling from said gap 29. Moreover, the pressure reducing chamber 34 and the collecting chamber 36 are coupled with a suction device (not shown) respectively through suction hoses 37 and 38.

Thus, when pressure in the pressure reducing chamber 34 of the seal ring 30*a* is reduced through the suction hose 37, the granular material entering the gap 29 from the hopper 1 is caused to accumulate on the front face of the porous member 35 of the pressure reducing chamber 34 due to deaeration of the granular material in response to reduction of pressure in the pressure reducing chamber 34, which is provided in the gap 29. Since the granular material is gradually piled up on the front face of the porous member 35 so as to fill the gap 29, the gap 29 is sealed by the granular material itself which is compacted through accumulation thereof on the front face of the porous member 35. Accordingly, the granular material does not leak out of the hopper 1 through the gap 29 of the sealing unit 7 even if the rotary shaft 27 of the stirrer 4 is rotated.

Meanwhile, when pressure in the collecting chamber 36 of the retaining housing 33 is reduced through the suction hose 38 simultaneously with reduction of pressure in the pressure reducing chamber 34, any granular material leaking out of the gap 29 is immediately carried from the collecting chamber 36 to the suction hose 38 by air flowing into the collecting chamber 36 from an inflow port 38*a* for atmosphere so as to be discharged through the suction hose 38. Since the collecting chamber 36 is arranged to simply draw thereinto the granular material which has leaked out of the gap 29, the amount of reduction of pressure in the collecting chamber 36 may be smaller than that of the pressure reducing chamber 34 in the sealing housing 30. Furthermore, it becomes possible to completely prevent the granular material from leaking out of the bearing 32 by providing a bearing cover 60 at an upper portion of the bearing 32.

Hereinbelow, the sealing unit 9 provided on the coupling portion between the duct 5 and the rotary wheel 2 will be described with reference to FIG. 6. The duct 5 and the rotary wheel 2 are, respectively, disposed above and below the coupling portion therebetween. A portion of an upper outer periphery of the rotary wheel 2 of annular shape is enclosed by a substantially rectangular opening formed at a lower end of the duct 5 such that the granular material falling down from the duct 5 is supplied into the filling holes 11 formed on the outer periphery of the rotary wheel 2. The filling holes 11 each having a recessed configuration of predetermined dimensions for receiving the granular material are formed in the outer periphery of the rotary wheel 2 at a predetermined circumferential pitch and extend in the radial directions of the rotary wheel 2. The rotary wheel 2 includes a drum 40 and a driving shaft 41 provided at the center of the drum 40. The duct 5 has the feed opening 39 for the granular material and the drum 40 is rotatably provided just below the feed opening 39 so as to be rotated about the driving shaft 41. The driving shaft 41 of the drum 40 is coupled with a driving device 42 (FIGS. 1 and 2) so as to be rotated intermittently in the counterclockwise direction in FIG. 1 by the driving unit 42. Furthermore, the coupling portion between the feed opening 39 of the duct 5 and the portion of the upper outer periphery of the drum 40 is sealed by the sealing unit 9.

Figure 8:
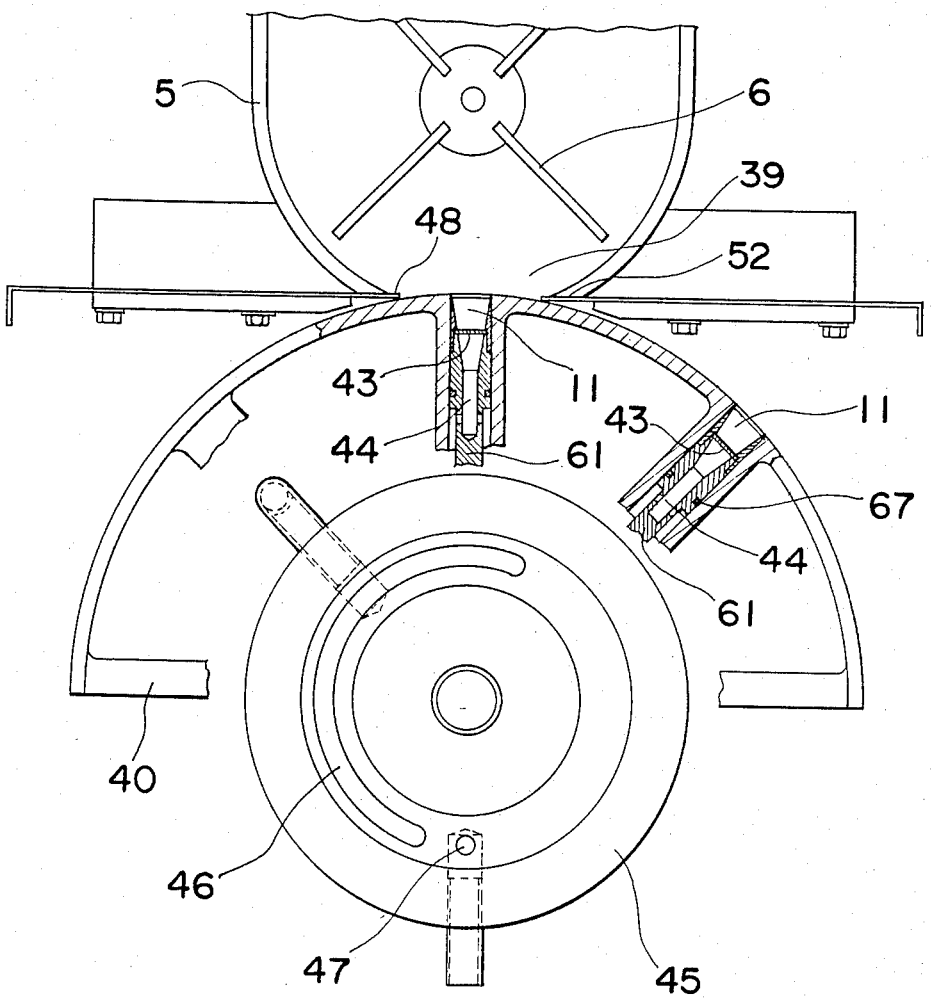
FIG. 8 is a cross section taken along the line VIII—VIII in FIG. 6.
Figure 9:
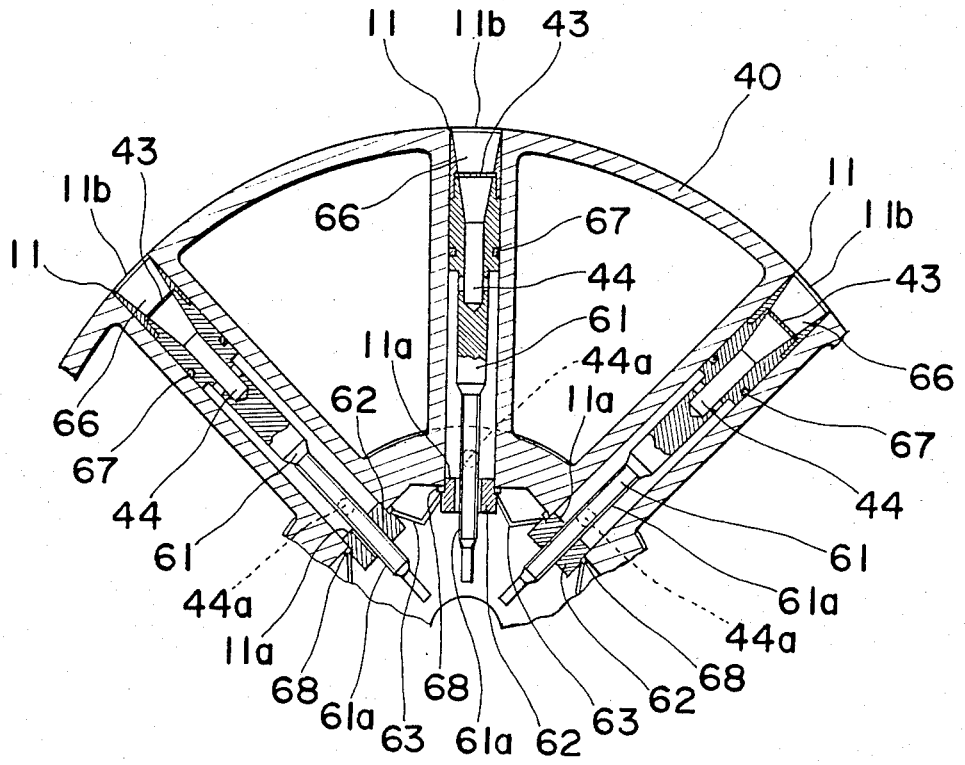
FIG. 9 is a fragmentary cross-sectional view showing, on an enlarged scale, part of the arrangement of FIG. 7.

More specifically, each of the filling holes 11 provided on the outer periphery of the drum 40 is formed into a shape of truncated cone having a large diameter portion thereof disposed at an inlet of each of the filling holes 11 so as to facilitate entry of the granular material into or discharge of the granular material from the filling holes 11. A filter 43 provided with pores of 2 to 5 microns in diameter and having an aperture ratio of 30 to 60% is disposed at a bottom face of a small diameter portion of the trancated cone and a suction chamber 44 is provided below the filter 43. As shown in FIGS. 8 and 9, the suction chamber 44 for each of the filling holes 11 is provided so as to be operatively connected to a suction groove 46 of a slide valve 45 through a communicating passage 44*a* formed on each of the filling holes 11, which slide valve 45 is fixedly provided in parallel with the drum 40.

In the case where one of the filling holes 11 rotating together with the drum 40 is disposed at the filling position whereat the feeding opening 39 of the duct 5 confronts the corresponding one of the filling holes 11, air is sucked into the corresponding suction chamber 44 through a suction hose connected to a vacuum solenoid valve (not shown) and thus, the granular material in the duct 5 is drawn from the feed opening 39 into the filling hole 11 so as to fill the filling opening 11.

Meanwhile, in the case where the filling hole 11 is disposed at a feeding position whereat the drum 40 is rotated through 180° from the filling position in the counterclockwise direction in FIG. 1, each of the vials A transported by the conveyor 3 is caused to stop for a predetermined time period by two escapement wheels driven by a driving shaft when the vial A is moved to a position just below the filling hole 11 located at the feeding position as shown in FIG. 1. When the vial A is moved to the position just below the filling hole 11 at a stop as described above, air is supplied into the suction chamber 44, through an exhaust hose provided with a compressed-air solenoid valve, and the communicating passage 44*a*, from an exhaust port 47 of the slide valve 45, so that a predetermined amount of the granular material filled in each of the filling holes 11 is caused to fall down so as to be supplied into each of the vials A. The distance of the filter 43 provided at the bottom face of each of the filling holes 11 from the top face of each of the filling holes 11 can be changed by moving a slide shaft 61 upwardly or downwardly, the amount of the granular material filled in each of the filling holes 11 can be adjusted.

Figure 10:
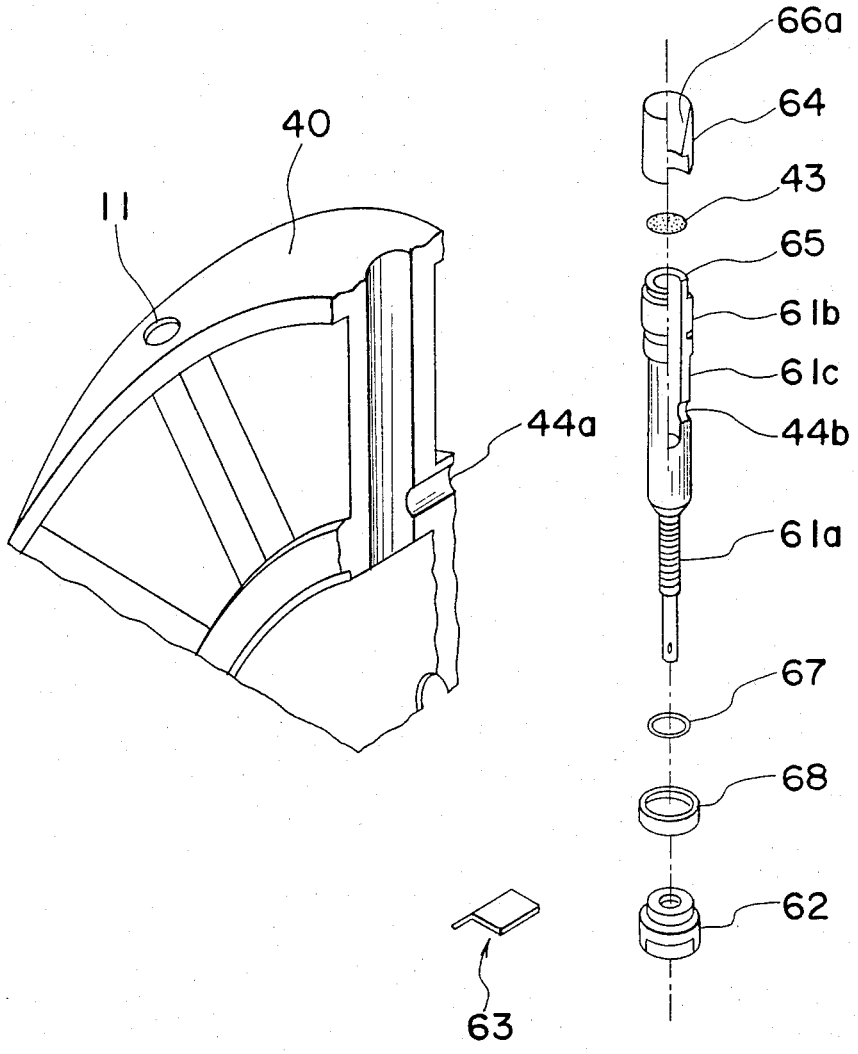
FIG. 10 is a fragmentary exploded perspective view showing part of the arrangement of FIG. 9.

As shown in FIGS. 9 and 10, each slide shaft 61 is slidably fitted into a corresponding one of a plurality of fitting holes 11 extending through the annular drum 40 of the rotary wheel 2 in the radial direction of the drum 40 at intervals of a predetermined angle so as to be slid in an upper opening 11*b* of each of the filling holes 11 through an O-ring 67, which upper opening 11*b* is disposed outwardly of a lower opening 11*a* of each of the filling holes 11 in the radial direction of the drum 40. The slide shaft 61 includes a leg portion having a threaded portion 61*a*, a body portion 61*c*, a head portion 61*b*, and a stepped portion 65 arranged in the recited order from the radial inner end (FIG. 10). A nut 62 engaged with the threaded portion 61*a* of the slide shaft 61 is brought into contact with the lower opening 11*a* of each of the opening holes 11 through a packing 68 so as to be retained at each of the filling holes 11 by an urging force of a retaining spring 63. The retaining spring 63 straddles each pair of the slide shafts 61 so as to urge the slide shafts into the corresponding filling holes 11. Accordingly, if positional adjustments of the nut 62 relative to the threaded portion 61*a* are performed, positions of an inlet cylinder 64 receiving the filter 43 of the slide shaft 61 can be variously adjusted with respect to the upper opening 11*b* of each of the filling holes 11. The inlet cylinder 64 is fitted around the stepped portion 65 and the body portion 61*c* is provided with the suction chamber 44.

More specifically, the filter 43 is interposed between the inlet cylinder 64 and the stepped portion 65, so that the filter 43 acts as a bottom face of a filling portion 66 of truncated cone formed in the inlet cylinder 64 for receiving the granular material, while a lower face of the filter 43 is communicated with the suction chamber 44 of the body portion 61*c* so as to be further communicated, through a bleeder 44*b* of the suction chamber 44 and the communicating passage 44*a* of each of the filling holes 11, with the suction groove 46 or the exhaust port 47 of the slide valve 45 confronting the drum 40. The filling portion 66 is formed by the inner peripheral face of the inlet cylinder 64, the upper face of the filter 43 and a portion of an inner peripheral face of each of the filling holes 11, which portion projects upwardly from the inlet cylinder 64.

In the case where about 200 mg of pharmaceutical granular material having a particle diameter of about 3 microns is filled in the filling portion 66, the inside diameter of each of the filling holes 11 at the inlet thereof, the height of the above described portion of the inner peripheral face of each of the filling holes 11, the height of the inlet cylinder 64, and the inside diameter of each of the filling holes 11 at the upper face of the filter 43, are preferably 9.2 mm, 1 mm, 10 mm and 6 mm, respectively. The inner peripheral face of the inlet cylinder 64 is formed into a tapered face 66*a* inclining at an angle of 4°17′30″ or so. Accordingly, since the filling portion 66 is shaped substantially as a truncated cone with the large diameter portion and the small diameter portion thereof, respectively, disposed at the inlet and the bottom face of the filling portion 66, distribution of density of the granular material in the filling portion 66 becomes uniform, and the granular material in the compacted state can be discharged from the filling portion 66 smoothly and rapidly, whereby such undesirable phenomena as the discharging of the granular material from the filling portion 66 is slow during a later stage thereof and the granular material remains in the filling portion 66 after the discharging of the granular material from the filling portion 66 can be effectively eliminated.

Furthermore, the filter 43 constituting the bottom face of the filling portion 66 is made of either elastic sheets such as wire mesh, etc. or filmy materials such as film, etc. When the granular material is filled in the filling portion 66, the filter 43 assumes a concave shape recessed at the side of the granular material due to the effect of suction of air thereinto so as to make the pores of the filter 43 in contact with the granular material smaller in size such that the granular material is positively accommodated in the filling portion 66. When the granular material is discharged from the filling portion 66, the filter 43 assumes a convex shape protruding towards the granular material due to effect of exhaust of air therefrom, so that air is caused to pass through the pores of the filter 43 smoothly and thus, the granular material is positively discharged from the filling portion 66 without clogging of the granular material in the pores of the filter 43. Furthermore, when the granular material is discharged from the filling portion 66, the filter 43 functions as a diaphragm so as to push the granular material in the compacted state out of the filling portion 66 with a stroke, so that the granular material is rapidly discharged from the filling portion 66 and thus, the earlier mentioned undesirable phenomenon that the discharging of the granular material from the filling portion 66 becomes slow in a later stage thereof is eliminated. In addition, since the filter 43 has a substantially planar configuration, the face of the filter 43 in contact with the granular material has a substantially flat surface, so that the granular material is easily separated from the filter 43 when the granular material is discharged from the filling portion 66 and thus, the granular material does not remain in the filling portion 66 after the discharging of the granular material from the filling portion 66.

As shown in FIG. 8, a doctor blade 48 for scraping the granular material filled in the filling portion 66 is provided forwardly of the feed opening 39 of the duct 5 in the rotational direction of the drum 40 such that a predetermined amount of the granular material is filled in every filling hole 11 at all times.

Figure 6:
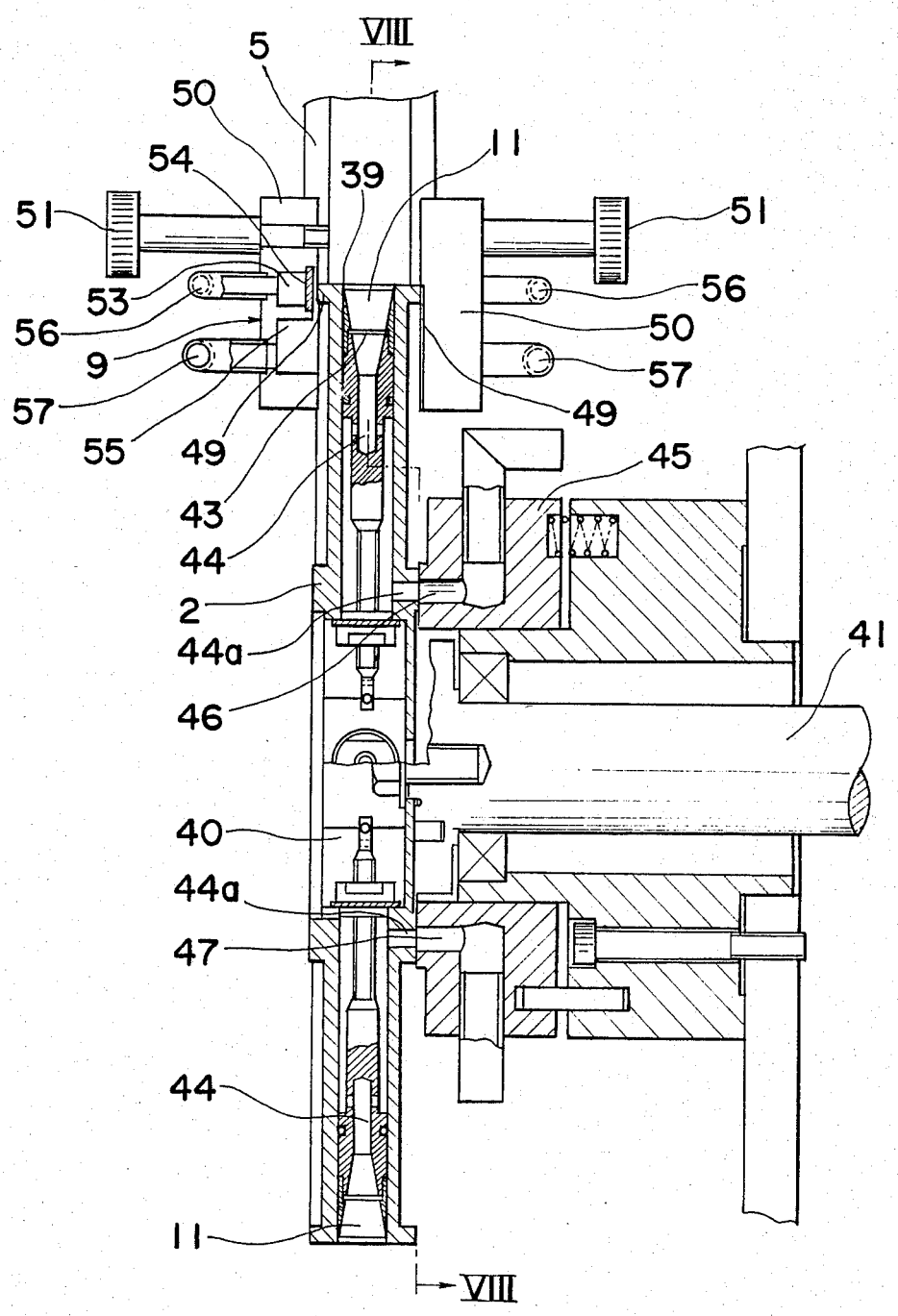
Figure 7:
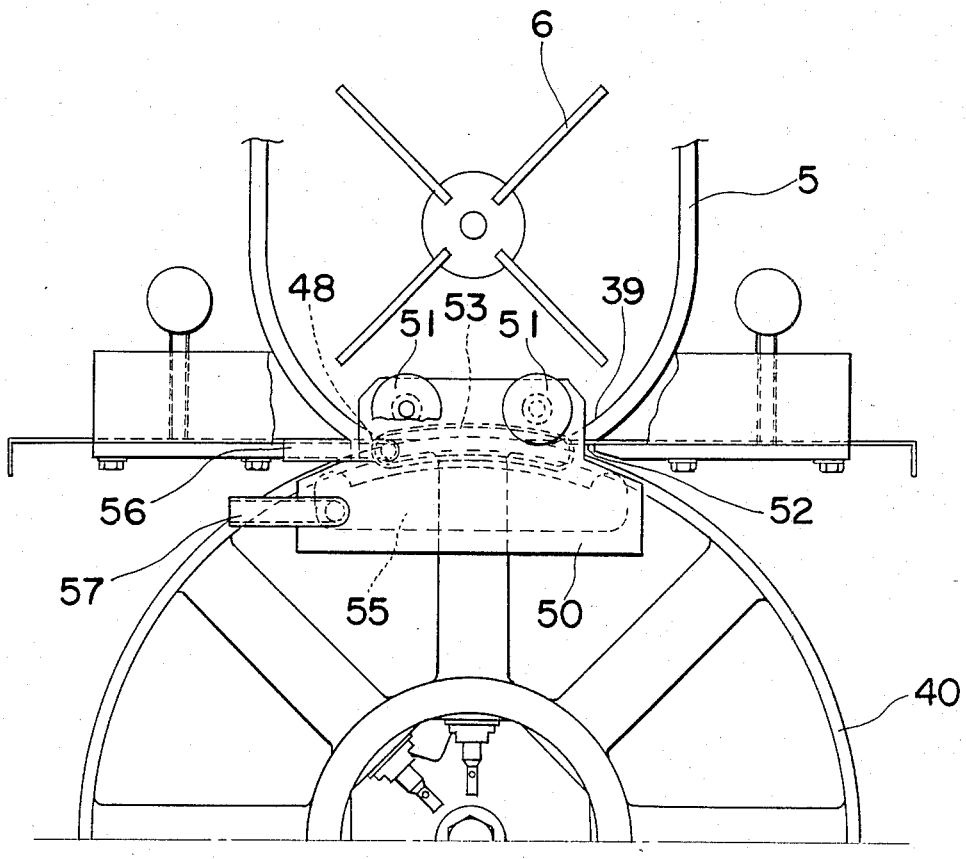
FIG. 7 is a fragmentary front elevational view of the sealing arrangement of FIG. 6.

Furthermore, as shown in FIGS. 6 and 7, in the sealing unit 9 provided at the feed opening 39 of the duct 5, a gap or clearance 49 of a predetermined dimension large enough to rotate the drum 40 is formed between the outer face of each of opposite side walls of the feed opening 39 of the duct 5 and each of the opposite side faces of the drum 40, which opposite side faces of the drum 40 are disposed at a radially outermost portion of the drum 40 in close proximity to the feed opening 39. A pair of sealing blocks 50 for sealing the outer periphery of the drum 40 are secured to front and rear side faces of the duct 5 with bolts 51 so as to hang down from the feed opening 39 of the duct 5. The sealing blocks 50 each forming a sealing housing are positioned so as to confront the upper side faces of the drum 40 such that the gaps 49 are defined therebetween as described above. The doctor blade 48 and a partition plate 52 are, respectively, provided at the left and right side faces of the duct 5 so as to completely seal the gap between the feed opening 39 of the duct and the outer periphery of the drum 40 confronting the feed opening 39. Moreover, a pressure reducing chamber 53 having the shape of an arcuate groove is defined in the inner side face of each of the sealing blocks 50 confronting the opposite side faces of the drum 40 and forming the gap 49. A porous member 54 similar to the porous member 10 of the sealing unit 8 for the rotary blades 6 is covers the front opening of the pressure reducing chamber 53, and a collecting chamber 55 is provided so as to collect the granular material falling down thereinto through a passage which is along the outside of the porous member 54, communicated with each of the gaps 49. In addition, the pressure reducing chamber 53 and the collecting chamber 55 are connected to a suction device (not shown) such as a vacuum pump, etc. through suction hoses 56 and 57, respectively.

Thus, when pressure in the pressure reducing chamber 53 of the sealing block 50 is reduced through the suction hose 56, the granular material contacting the surface of the porous member 54 as it comes through the gap 49 between the duct 5 and the drum 40 is caused to accumulate on the front face of the porous member 54 due to deaeration of the granular material in response to reduction of pressure in the pressure reducing chamber 53. Since the granular material is gradually piled up on the front face of the porous member 54 so as to fill the gap 49, the gap 49 is sealed by the granular material itself which is compacted through accumulation thereof on the front face of the porous member 54. Accordingly, such an undesirable phenomenon that the granular material leaks out of the duct 5 through the gaps 49 of the sealing unit 9 even if the drum 40 is rotated is avoided.

When pressure in the collecting chamber 55 is reduced through the suction hose 57 simultaneously with reduction of pressure in the pressure reducing chamber 53, and granular material leaking out of the gap 49 is immediately sucked from the collecting chamber 55 through the suction hose 57 so as to be discharged out of the suction hose 57. Since the collecting chamber 55 is arranged to simply suck thereinto the granular material which has leaked out of the gap 49, the amount of reduction of pressure in the collecting chamber 55 may be smaller than that of the pressure reducing chamber 53 by sucking atmospheric air into the collecting chamber 55 through the gap between the sealing block 50 and the drum 40 as shown in FIG. 6.

As shown in FIG. 7, when forward and rearward ends of the collecting chamber 55 disposed below the pressure reducing chamber 53 having the shape of the arcuate groove are raised upwardly to a level adjacent to the pressure reducing chamber 53, the granular material rotating together with the drum 40 can be sucked into the forward and rear ends of the collecting chamber 55.

Accordingly, the granular material filling apparatus according to the present invention includes the sealing unit 8 (FIG. 4) for the shaft of the rotary blade 6, the sealing unit 7 (FIG. 5) for the shaft of the stirrer 4 and the sealing unit 9 (FIG. 6) for the coupling portion between the duct 5 and the rotary wheel 2. Since the sealing units 8, 7 and 9 respectively include the porous member 10 provided in the pressure reducing chamber 23, the porous member 35 provided in the pressure reducing chamber 34, and the porous member 54 provided in the pressure reducing chamber 53, the gaps 21, 29 and 49 are sealed through piling up of the granular material itself on the porous members 10, 35 and 54, respectively. Furthermore, any small amount of the granular material leaking out of the gaps 21, 29 and 49 filled with the granular material is immediately sucked from the collecting chambers 24, 36 and 55 to the suction hoses through effect of suction of air brought about by the collecting chambers 24, 36 and 55 so as to be discharged out of the suction hoses, respectively.

As is clear from the foregoing description, the granular material processing apparatus according to the present invention includes the stationary container means for storing and transferring the granular material, the movable processing means coupled with a driving means for stirring and dispensing the granular material, the stationary container means and the movable processing means being provided adjacent to each other so as to constitute part of the processing machine, and the sealing arrangement for preventing leakage of the granular material filled in the stationary container means out of the stationary container means through the gap between the stationary container means and the movable processing means. The sealing arrangement further includes the porous plate means which is provided with a large number of the pores having diameters smaller than the particle diameters of the granular material and extending through the porous plate means from a front face to a reverse face thereof, and which is provided on the surface of a portion of the stationary container means confronting the movable processing means, and the pressure reduction introducing portion provided between the stationary container means and the porous plate means for coupling the reverse face of the porous plate means with the pressure reducing means, thereby to tightly close the gap between the stationary container means and the movable processing means by the granular material attracted onto the front face of the porous plate means.

Furthermore, the granular material processing apparatus according to the present invention includes a rotary wheel having a plurality of filling holes formed in the peripheral portion thereof, which is arranged to be intermittently rotated between the granular material filling position and the granular material dispensing position, each of the granular material filling holes open to the peripheral portion of the rotary wheel being provided with a filter at its bottom face so as to draw the granular material into the filling hole through the opening by sucking action from the filter, and also to discharge the granular material in the filling hole out of the opening by action of air fed through the filter, each of the filling holes having a cylindrical configuration and being provided therein with a cylinder adjustably received in the filling hole for positional adjustment thereof, the filter is provided in the flat bottom face of the cylinder, with the inner face of the cylinder having a tapered configuration increasing in size from the filter towards the opening of the filling hole in the peripheral portion of the rotary wheel.

Accordingly, in accordance with the present invention, since an optimum sealing effect can be maintained at all times without the need for providing packings required in the conventional granular material processing apparatuses, such undesirable phenomena as malfunctionings due to wear of the packings or leakage of the granular material due to deterioration of the packings can be eliminated. The granular material sealing apparatus of the present invention is sealed by the granular material itself so as to completely prevent entry of foreign matters such as powdery splinters and fragments of the packings thereinto and therefore, is most suited for use with pharmaceutical granular material.

Furthermore, in accordance with the present invention, since pressure in the portion adjacent to the gap having the granular material piled up therein is reduced, the granular material leaking out of the gap can be sucked so as to be removed from the granular material processing apparatus, so that such undesirable phenomena that the granular material which has leaked out of the granular material processing apparatus scatters around and further clogs other apparatuses provided adjacent to the granular material processing apparatus are avoided and thus, operation of the granular material processing apparatus can be performed in a sanitary manner.

Moreover, in the arrangement according to the present invention as described so far, since the inner peripheral face of the cylinder provided in each of the filling holes has a tapered configuration, with the diameter of its inlet portion being larger than that at its bottom portion the granular material is uniformly distributed into density when introduced in the cylinder, while being efficiently removed therefrom during discharge without remaining around the filter, and thus, not only is the filling accuracy appreciably improved, but the discharging may also be effected with high accuracy, owing to the fact that almost no friction is produced between the granular material in the compacted state and the inner face of the cylinder, and that the compacted granular material is rapidly discharged in a lump without remaining in the cylinder. Furthermore, since the filter provided at the bottom face of the cylinder is formed of a flexible thin sheet or film so as to act as in a diaphragm during discharge, the compacted granular material may be rapidly discharged without remaining, and, during filling of the granular material into the cylinder, the filter assumes a concave configuration with respect to the granular material so as to narrow the individual openings in the surface thereof contacting said granular material, while during discharge of the granular material, the filter is conversely raised at its central portion into a convex configuration, with the openings therein being enlarged for efficient discharge, and thus, clogging of the filter may be prevented. Moreover, since undulation at the boundary face between the filter and the granular material is advantageously reduced, the granular material may be readily separated from the filter during discharging, without the granular material remaining within the filling holes.

The advantages available from the arrangement according to the present invention as described above may be clearly noticed in the data of experiments as given below.

| | Conventional filling apparatus (cylindrical filling hole) | Filling apparatus of the present invention (conical filling portion) |
|---|---|---|
| Remaining of granular material within filling holes | 10 holes (10%) | 0 |
| Amount of granular material remaining within filling holes | 50 mg at maximum | 0 |
| Part of discharged granular material scattering outside | 4200 vials (60%) | 0 |
| Overall filling accuracy | ±12% | ±3 |

The above data are based on the results obtained from a comparative experiment carried out between the filling apparatus according to the present invention and a conventional filling apparatus under the conditions as follows.

| | |
|---|---|
| Number of vials inspected: | 7000 vials respectively for the filling apparatus of the present invention and the conventional filling apparatus |
| Number of inspections of filling holes: | 100 times |
| Target value for filling amount: | 200 mg ± 5% |
| Filling speed | 120 vials/minute. |

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A granular material processing apparatus which comprises a stationary container means for storing and transferring granular material, a movable processing means adapted to be coupled with a driving means for stirring and dispensing the granular material, said stationary container means and said movable processing means each having at least one part provided adjacent to a corresponding part on the other so as to constitute part of said processing apparatus and having a gap therebetween, and a sealing arrangement for preventing leakage of the granular material from the stationary container means through the gap between said stationary container means and said movable processing means, said sealing arrangement having a porous plate with a large number of pores therein having diameters smaller than the particle diameters of the granular material and extending through said porous plate from a front face to a rear face thereof, and which porous plate is positioned on the surface of a portion of said stationary container means part in spaced opposed relation to said movable processing means part, and a pressure reduction introducing space provided between said stationary container means and said porous plate to which the rear face of said porous plate is exposed, and a pressure reducing means communicated with said space, whereby a granular material attracted onto the front face of said porous plate by the reduced pressure in said space tightly closes the gap between said stationary container means and said movable processing means.

2. A granular material processing apparatus which comprises a stationary container means for storing and transferring granular material, a movable processing means adapted to be coupled with a driving means for stirring and dispensing the granular material, said stationary container means and said movable processing means being provided adjacent to each other so as to constitute part of said processing apparatus and having a gap therebetween extending from inside said container means to outside said container means, and a sealing arrangement for preventing leakage of the granular material from the stationary container means through the gap between said stationary container means and said movable processing means, said sealing arrangement having a porous plate with a large number of pores therein having diameters smaller than the particle diameters of the granular material and extending through said porous plate from a front face to a rear face thereof, and which porous plate is positioned on the surface of a portion of said stationary container means in spaced opposed relation to said movable processing means, a pressure reduction introducing space provided between said stationary container means and said porous plate to which the rear face of said porous plate is exposed, a pressure reducing means communicated with said space, and a granular material collecting space provided on side of said porous plate toward the outside of said stationary container means into which said gap opens and having a granular material removing means connected thereto, whereby granular material attracted onto the front face of said porous plate by the reduced pressure in said pressure reduction introducing space tightly closes the gap between said stationary container means and the movable processing means, and whereby the granular material leaking through said gap is forcibly removed from said granular material collecting space.

3. A granular material processing apparatus as claimed in claim 1 or 2, wherein said stationary container means includes a hopper member for storing the granular material therein, and a duct portion extending downwardly from said hopper member and communicated with said hopper member for receiving the granular material fed from said hopper member and having a granular material supply port at the lower end thereof, said rotary processing means includes a stirrer rotatably mounted within said hopper member for stirring the granular material contained therein and a stirrer shaft on which said stirrer is mounted and mounted in an opening in said hopper member, a rotary blade member rotatably mounted in said duct portion below said hopper member for directing the granular material fed from said hopper member downwardly and a blade member shaft on which said rotary blade member is mounted and mounted in an opening in said duct portion, and a rotary wheel rotatably mounted below said granular material supply port and having a plurality of filling holes at predetermined intervals around the periphery thereof for receiving the granular material from said duct portion and for dispensing the granular material in said filling holes successively into vials transported past said rotary wheel, and said stationary container means further comprises a connecting portion between the lower end of said duct portion and said rotary wheel, the part of said hopper member around said stirrer shaft and said stirrer shaft having a gap therebetween, the part of said duct portion around said blade member shaft and said blade member shaft having a gap therebetween, and said connecting portion and said rotary wheel having a gap therebetween, and a sealing arrangement at each gap.

4. A granular material processing apparatus as claimed in claim 3, wherein said rotary wheel is intermittently rotatable between a granular material filling position and a granular material dispensing position, each of said granular material filling holes in the periphery of said rotary wheel having a filter in the bottom thereof to support the granular material filled into the filling hole, and means communicating with said filters for creating suction on said filters in a direction into said filling holes for holding granular material in the filling holes, and means for supplying air under pressure to said filters for assisting discharge of granular material from said filling holes.

5. A granular material processing apparatus as claimed in claim 4 in which each of said filling holes has a cylindrical configuration and has a hollow cylinder mounted therein for movement into and out of the hole for adjusting the position of said cylinder in said hole, said filter being mounted on the radially inner end of said cylinder, the inner peripheral surface of said cylinder having a tapered configuration diverging from said filter radially outwardly of the filling hole.

* * * * *